US006135723A

United States Patent [19]

Hatton

[11] Patent Number: 6,135,723

[45] Date of Patent: Oct. 24, 2000

[54] EFFICIENT MULTISTAGE PUMP

[76] Inventor: Gregory John Hatton, 13279 Hunters Lark, San Antonio, Tex. 78230

[21] Appl. No.: 09/232,609

[22] Filed: Jan. 19, 1999

[51] Int. Cl.[7] ..... F04B 28/00

[52] U.S. Cl. ..... 417/251; 417/252; 417/308; 417/310

[58] Field of Search ..... 417/251, 252, 417/308, 310; 418/9, 15

[56] References Cited

U.S. PATENT DOCUMENTS

| | | | |
|---|---|---|---|
| 1,317,370 | 9/1919 | Holdaway | 418/9 |
| 2,381,695 | 8/1945 | Sennet | 417/252 |
| 5,779,451 | 7/1998 | Hatton | 417/205 |

FOREIGN PATENT DOCUMENTS

WO0940
27049A1 11/1994 WIPO .

*Primary Examiner*—Timothy S. Thorpe
*Assistant Examiner*—Cheryl Tyler
*Attorney, Agent, or Firm*—Russell J. Egan

[57] ABSTRACT

A multi-stage pump has a housing defining a plurality of stages each having an internal rotor enclosure with each enclosure having a non-pumping inlet and outlet. A plurality of rotor assemblies are operatably contained in housing extending through all of the stages. The rotor assemblies and rotor enclosures are shaped to provide a smaller inlet volumetric delivery rate at the last (downstream or outlet) stage than at the first (upstream or inlet) stage. A plurality of fluid lines connect the non-pumping chambers to enable the pump to handle liquid so that, as the rotor assemblies are rotated, a fluid stream entering the pump inlet is subjected to a pumping action to transport the fluid stream to exit through the pump outlet.

19 Claims, 5 Drawing Sheets

EFFICIENT MULTISTAGE PUMP

BACKGROUND OF THE INVENTION

1. The Field of the Invention

The present invention relates to an apparatus for pumping multiphase fluids, as in oil field production, particularly to a multistage pump for providing a large pressure boost to high gas-fraction inlet streams. More specifically, the invention relates to a multi-screw pump having multiple stages, to provide better power efficiency than traditional twin-screw pumps for high-pressure boost operation at gas fractions up to 100% without seizing or loss of pressure boost.

2. Background of the Invention

Drilling for oil and gas is an expensive, high-risk business, even when the drilling is carried out in a proven field. Petroleum development and production must be sufficiently profitable over the long term to withstand a variety of economic uncertainties. Multiphase pumping is increasingly being used to aid in the production of wellhead fluids. Both surface and subsea installations of these pumps are increasing well production. Multiphase pumps are particularly helpful in producing remote fields and many companies are considering their use for producing remote pockets of oil and for producing deep water reservoirs from remote facilities located in shallower water. Such multiphase pumps allow producers to transport multiphase fluids (oil, water, and gas) from the wellheads to remote processing facilities (instead of building new processing facilities near the wellheads and often in deep water). These multiphase pumps also allow fluid recovery at lower final reservoir pressures before abandoning production. Consequently, there is a greater total recovery from the reservoir.

For deep water reservoirs, producers are very interested in using multiphase pumps to transport wellhead fluids from deep water wellheads to remote processing facilities located in shallower water. While there are a number of technical difficulties in this type of production, the cost savings are very large. Building processing facilities over reservoirs in waters of 6,000 to 10,000 feet deep costs tens of billions of dollars, as compared to a cost of hundreds of millions of dollars to build similar facilities in moderate water depths of 400 to 600 feet. Consequently, producers would like to transport wellhead fluids from the sea-floor in deep waters through pipelines to remote processing facilities in moderate water depths.

Currently transport distances of 30 to 60 miles are being considered. In many locations around the world, a 30 to 60 mile reach from the edge of the continental shelf into deeper waters significantly increases the number of oil reservoirs which could be produced. In the Gulf of Mexico, for example, such a reach from water depths of 600 feet typically goes to water depths of 6,000 feet and deeper. In the near future, greater reaches up to 100 miles are envisioned. Multiphase pumps are a design being considered for supplying the pressure boost required for this long distance transport of wellhead fluids. The multiphase pumps typically have one end connected to a Christmas tree manifold, whose casing head is attached to the wellheads from which fluids flow as a result of indigenous reservoir energy, and the other end of the pumps are connected to a pipeline which transports the fluids from the wellhead to the remote processing site.

Wellhead fluids can exhibit a wide range of chemical and physical properties. These wellhead fluid properties can differ from zone to zone within a given field and can change with time over the course of the life of a well. Furthermore, well bore flow exhibits a well-known array of flow regimes, including slug flow, bubble flow, stratified flow, and annular mist, depending on flow velocity, geometry, and the aforementioned fluid properties. Consequently, the ideal multiphase pump should allow for a broad range of input and output parameters without unduly compromising pumping efficiency and service life.

Pumping gas-entrained liquids of varying gas content presents a difficult design problem. Some of these pumps have included: twin-screw pumps; helico-axial pumps; counter-rotating pumps; piston pumps; and diaphragm pumps. Twin-screw pumps are one of the favored types of pumps for handling the wide range of liquid/gas ratios found in wellhead fluids. Nevertheless, this type of pump has its detractions. For example, two well-known problems for twin-screw pumps are seizing and low efficiency.

A twin-screw pump has two rotors that rotate in a close fitting casing (rotor enclosure). For a given inlet volumetric rate, gas fraction increases result in mass rate reduction, decreases in the thermal transport capacity of the pumped fluids, and temperature elevations in the pump. At very high gas fractions and high pressure boosts the pump can lose its rotor-rotor or rotor-housing seals and the flow through the pump can stall; this leads to further temperature elevation in the pump. Consequently, at high pressure boosts, for a given set of operating conditions, a critical gas fraction exists. Pumping at gas fractions greater than the critical gas fraction will result in excessive heating of the pump rotors causing an expansion of the rotors such that the rotors may interfere with the pump body (rotor enclosure) causing the pump to seize.

In typical oil field applications, the gas fraction (or percentage of gas content of the wellhead fluid by volume at inlet conditions) is required to be less than some upper limit for a given pump pressure boost. This limit is typically 95% or greater gas fraction for pressure boosts of around 900 psi. In order to ensure that wellhead fluids do not exceed this requirement, several approaches have been taken including: (1) buffer tanks have been added upstream of the pump to dampen excessive gas/liquid ratio variations; (2) liquids from the pump outlet, or other liquids, are commingled with inlet stream fluids to reduce the inlet gas fraction; or (3) combinations of (1) and (2) are used to reduce the inlet gas fraction. Method (1) extends the operational range of the pump marginally and methods (2) and (3) extend the operating range a little more, but they are extremely inefficient. Even with these approaches, used either singly or in combination, pump seizing may still occur.

A more power efficient twin-screw pump would have several advantages over traditional twin-screw pumps. These advantages include: (1) reduced likelihood of seizing since less heat is generated within the pumping chamber; (2) reduced requirement for recirculation systems, which further reduce the efficiency and consequently generate more heat which must be removed from the pumping chamber in order to prevent seizing; (3) reduced drive requirements (for example, electric motors), thus reducing initial capital investment and providing a smaller and less massive system; (4) reduced power transmission capacity requirements (for example, a fifty-mile subsea electrical power transmission system used with a common pump size costs millions of dollars and typically has transformers, special variable frequency drives, and other special equipment for long distance transmissions), thus reducing initial capital investments; (5) lower operating costs (for less power, typically pumps of several megawatt size are considered); (6) lower maintenance and servicing costs (this is due to a longer lifetime at lower power loads and reducing servicing costs due to reduced weight of the drive—recovering a subsea pump for servicing or replacement is very expensive and the required vessel size and time for this operation are dependent on the size and weight of the pump/drive system); and (7) an economical system in situations where a standard twin-screw pump system costs more than the value received for the recovered fluids by using it.

Therefore, there is a need for a power efficient twin-screw pump capable of providing a large pressure boost to high gas-fraction inlet streams without seizing or loss of pressure boost. The present invention constitutes an improvement over my U.S. Pat. No. 5,779,451 issued Jul. 14, 1998.

SUMMARY OF THE INVENTION

The present invention is a multistage pump which includes a housing having an internal rotor enclosure having an inlet, an outlet and a plurality of rotor assemblies operably mounted within the enclosure. Each rotor assembly has a shaft with a plurality of stages of outwardly extending threads affixed thereon, the threads in each stage being shaped to provide a non-uniform volumetric delivery rate along the length of each rotor assembly. The pump also has means for rotating the rotor assemblies, whereby a fluid stream entering from the inlet is subjected to a pumping action to transport the fluid stream to exit through the outlet.

In one embodiment, the rotor assemblies have a plurality of threaded pumping stages separated by unthreaded non-pumping stages. Further, the threads of each pumping stage may have a different screw profile to provide progressively decreasing inlet volumetric delivery rates from the inlet to the outlet of the rotor enclosure. In another embodiment, each non-pumping stage may have an increased rotor enclosure diameter.

In another aspect of the present invention, each non-pumping chamber is connected to the inlet of an upstream stage by a respective fluid line. Preferably, a valve is connected in the fluid line between the non-pumping chamber and the upstream-stage inlet to prevent fluids from flowing unless the chamber pressure is greater than the valve set pressure. In another embodiment, a secondary pump may be connected to the fluid line between the valve and upstream-stage inlet for utilizing the pressure difference between the non-pumping chamber and the upstream-stage inlet to pump fluid toward the pump outlet.

BRIEF DESCRIPTION OF THE DRAWINGS

The present invention will now be described, by way of example, with reference to the accompanying drawings in which.

DETAILED DESCRIPTION OF AN EMBODIMENT OF THE INVENTION

The present invention is directed to a multistage twin-screw pump that provides a large pressure boost to high gas-fraction inlet streams with lower power requirements. Reduction of power requirements reduces the chances of pump seizing, which is a well-known problem for twin-screw pumps providing a large pressure boost to high gas-fraction streams, and allows a more efficient, lower cost pressure-boosting multiphase pump.

Traditionally, twin-screw pumps have rotors designed to provide a uniform volumetric delivery rate along the length of the rotor section through a series of sealed chambers. Generally, this is accomplished by building pumps with rotors of a uniform profile over the length of the rotor. The rotor diameter, pitch, and other rotor characteristics may change from pump to pump, as required by a given application, but on each pump the rotor chamber volumetric capacity along the rotor is substantially constant.

Sometimes the rotors in a multiphase twin-screw pump are tapered to a slightly smaller diameter at the outlet end of the rotors to add additional rotor/rotor and rotor/body clearance. At high gas fractions and high pressure boosts, the outlet ends of the rotors are significantly heated and the additional clearance allows the pump to operate at these higher temperatures. But even for multiphase streams the pitch and other rotor/enclosure parameters are generally chosen to provide constant chamber volumes along the rotors for traditional twin-screw pumps.

This uniform volumetric delivery rotor/enclosure design is used because these pumps handle liquids either continuously or intermittently. If the volume of the rotor chambers changes along the rotor, then the volumetric rate changes proportionally. For a pump which handles liquids, it is usually advantageous to use rotor/enclosure designs which result in a constant volumetric rate along the rotors. To do otherwise, without special pump modifications, generally results in significant mechanical stresses because the liquids compress or force themselves through the seals or burst the pump in trying to reach a constant volumetric rate along the rotors.

For highly compressible inlet streams, such as multiphase gas/oil/water production streams from a well, a more efficient twin-screw pump rotor design is possible. The present invention concerns an improved multistage, twin-screw pump which allows pumping of all liquid streams and, in particular, more power-efficient pumping of highly compressible multiphase streams. This allows a more power efficient design for multiphase flow. The rotor design, along with the design of an auxiliary, provides a system which is able to handle incompressible streams.

Figure 1:
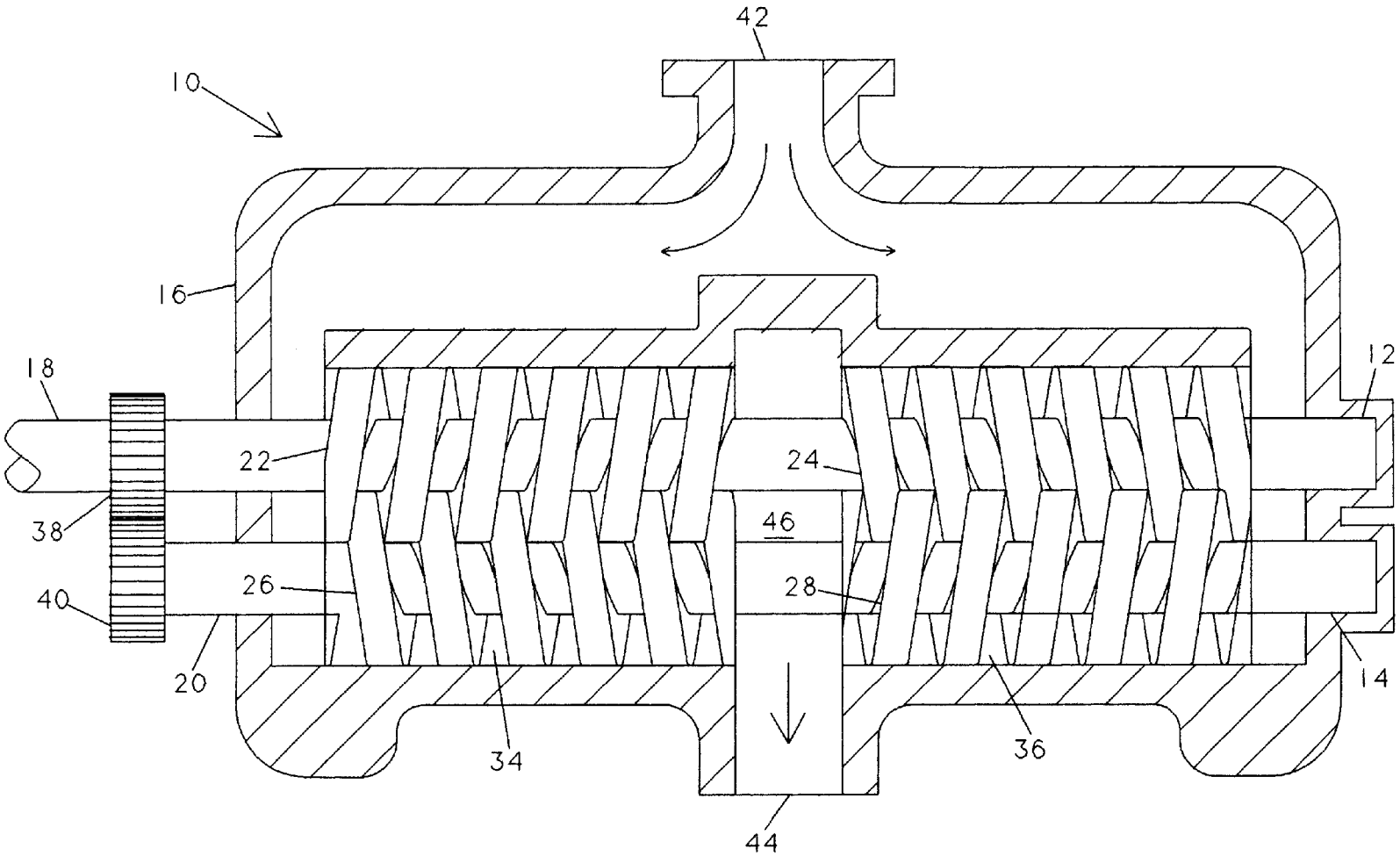
FIG. 1 PRIOR ART
FIG. 1 is a longitudinal section through a twin-screw pump according to the prior art.

FIG. 1 shows a longitudinal section through a known twin-screw pump 10 according to the prior art. The twin-screw pump 10 has two rotor assemblies 12 and 14 that are embodied within a close-fit casing or pump housing 16. Each rotor assembly has a shaft 18 and 20 with two or more portions formed with integral outwardly directed screw threads 22, 24, 26, 28 extending along at least a portion of the length of the respective shafts. The shafts 18 and 20 run axially within two overlapping cylindrical enclosures 30, 32 which, collectively, form the rotor enclosure (see FIG. 3). The threads of the two rotor assemblies 12, 14 are opposite handed to engage the threads of the opposite rotor assembly such that spiral chambers 34, 36 are formed within the rotor enclosure 30, 32. The pump 10 will be driven by a motor (not shown) which preferably drives one of the rotor assemblies 18. Drive gear 38 on shaft 18 engages a second drive gear 40 on shaft 14 such that, when rotor assembly 12 is driven by the pump motor, rotor assembly 14 is driven at the same rate but in the opposite direction.

Wellhead fluids, including particulate material, are drawn into pump 10 through inlet 42 and exit through outlet 44. Most twin-screw pumps have a pair of inlets located on the outer ends of the rotor assemblies and a single outlet 44 in the center of the pump. Thus as the rotor assemblies are turned, the threads 22, 24, 26, 28, or more properly, the rotor chambers 34, 36, displace the wellhead fluids coaxially annularly along the rotor shafts 18 and 20 toward the center of the pump where the wellhead fluids are discharged radially from the pump outlet. In the center of the housing 16 there is an outlet chamber 46 where the rotor shafts 18, 20 are exposed and are not threaded. When the fluids reach the outlet chamber 46, the point of greatest pressure, the fluids are discharged from the pump 10 through outlet 44. Alternatively, the rotor can be rotated in the opposite direction and the pump works backward with the inlet in the middle of the rotors and the outlets at the ends of the rotors.

In order to fully appreciate the advantages of the present invention, it is necessary to understand how twin-screw pumps work when pumping a multiphase fluid stream and when pumping incompressible fluids. The rotor threads of a twin-screw pump interact with each other and the rotor enclosure to form a number of spiral chambers. As the rotors turn, the chambers, in effect, move from the inlet end of the pump to the outlet end of the pump. The chambers are not completely sealed, but under normal operating conditions the normal clearance spaces (or seals) that exist between the rotor assemblies and between each rotor assembly and the adjacent enclosures are filled with liquid. The liquid in these clearance spaces, or seals, serves to limit the leakage of the pumped fluids between adjacent chambers. The quantity of fluid that escapes from the outlet side of the rotor assemblies back toward the inlet side represents the slip of the pump.

When pumping incompressible fluids, such as liquids, the pressure difference between adjacent chambers is nearly the same for all adjacent pairs of chambers. The total pressure boost is the sum of all these pressure differences (where the inlet and outlet chambers are considered the first and last chambers). The pressure difference between adjacent chambers forces some fluid through the seals (i.e., slippage). However, since the pressure difference between adjacent chambers is about the same across the length of the rotor assembly, then the slippage rate between each pair of adjacent chambers is about the same. Consequently the work and heat generation of the rotor assemblies is fairly uniformly distributed along the length of the rotor assemblies when pumping incompressible fluids. Furthermore, the outlet volumetric delivery is nearly constant with time.

In contrast, when pumping highly compressible fluids, such as high gas-fraction multiphase streams, the pressure difference between adjacent chambers changes significantly from the inlet ends of the rotor assemblies to the middle of the rotor assemblies, i.e., the outlet chamber. The largest pressure difference is between the outlet chamber 46 and the last stage rotor chamber 34, 36 nearest the outlet chamber 46. Consequently, the slippage rate for the fluid across the seal is greatest between the outlet chamber 46 and the last stage rotor chamber adjacent the outlet chamber. Since the fluids in the last stage rotor chamber 34, 36 are highly compressible, the fluids that flow across the seal between the outlet chamber 46 and the last rotor chambers do not result in a large pressure increase in these last stage rotor chambers.

Figure 2:
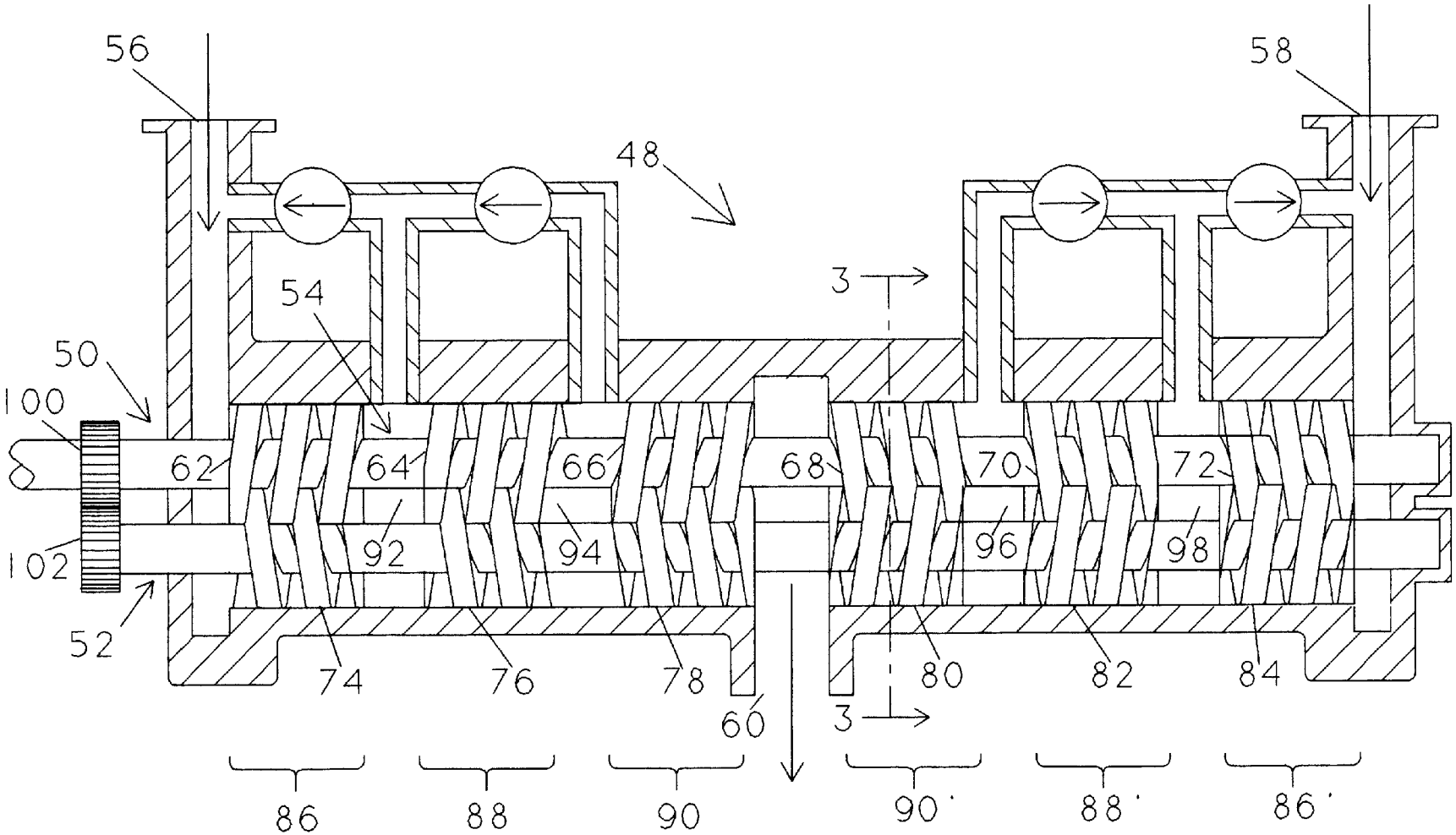
FIG. 2 is a longitudinal section through an embodiment of the multistage pump of the present invention.

The next largest pressure difference, and fluid slippage rate, is between the last stage rotor chamber, nearest the outlet, and the adjacent rotor chamber (the middle stage, as shown in FIG. 2). The closer an adjacent chamber pair is to the inlet, the smaller the pressure difference and fluid slippage rate between chambers. As a consequence of this, twin-screw pumps, at a given speed of revolution, have less fluid slippage back into the pump inlet for multiphase flow than for incompressible fluid flow as a function of pressure boost of the pump.

When the fluid stream is highly compressible and the greatest pressure difference is between the last stage rotor chamber and the outlet chamber, the volumetric output of the pump is not constant. The volumetric rate delivered to the outlet chamber becomes negative as the last stage rotor chamber opens to the outlet chamber (the fluids from the outlet chamber flow into the opened chamber). As the rotor assemblies continue to turn, the outlet volumetric rate becomes positive, since all, or at least most, of the fluids in the last stage rotor chamber at the time it opened to the outlet chamber (aside from fluids that slip through the seals into the adjacent lower-pressure rotor chamber) will ultimately be delivered to the outlet chamber before the next rotor chamber opens to the outlet chamber.

Consequently, when pumping highly compressible fluids with a twin-screw pump, a very large part of the compression occurs as the last stage rotor chamber opens to the outlet chamber and a substantial part of the overall work is done by the section of the rotor thread forming the seal between the outlet chamber and the last stage rotor chamber. In addition the bending of the rotor from a straight line is greatest in the middle of the pump. Consequently, this disproportionate amount of work by the rotor assembly generates large quantities of heat in that stage of the rotor assembly in pumps with a constant rotor and enclosure design. Thus, the rotor assembly stages adjacent to the outlet chamber generate the greatest quantity of heat along the length of the rotor. As the gas fraction increases, the compressibility of the fluid stream increases and a greater part of the total heat generated by the rotors is concentrated in outlet chamber and the last rotor stages adjacent to outlet chamber. This is where and when pump seizing is most likely to occur.

FIG. 2 is a longitudinal section through a twin-screw pump adapted to carry out the present invention. Although the view, and the discussion below, are of a pump with inlets at the outer ends of the rotor assemblies and an outlet at the middle of the rotor assemblies, this invention applies equally to pumps with substantially any inlet and outlet configurations. As in a traditional twin-screw pump, the subject multistage pump 48 has rotor assemblies 50 and 52 that drive the fluids within the rotor enclosure 54 from the inlets 56, 58 to the outlet 60. In this embodiment, however, the threads 62, 64, 66, 68, 70, 72, 74, 76, 78, 80, 82, 84 on each of the rotor assemblies 50, 52 are not continuous, but rather are separated into three sections or stages 86, 88, 90 by non-pumping chambers 92, 94, 96, and 98 which do not have any threads.

While the embodiments of the present invention have been shown with three stages, it will be appreciated by those skilled in the art that the principles of the invention can be applied to substantially any number of stages. Three stages allow for a clear and uncluttered drawing.

Figure 3:
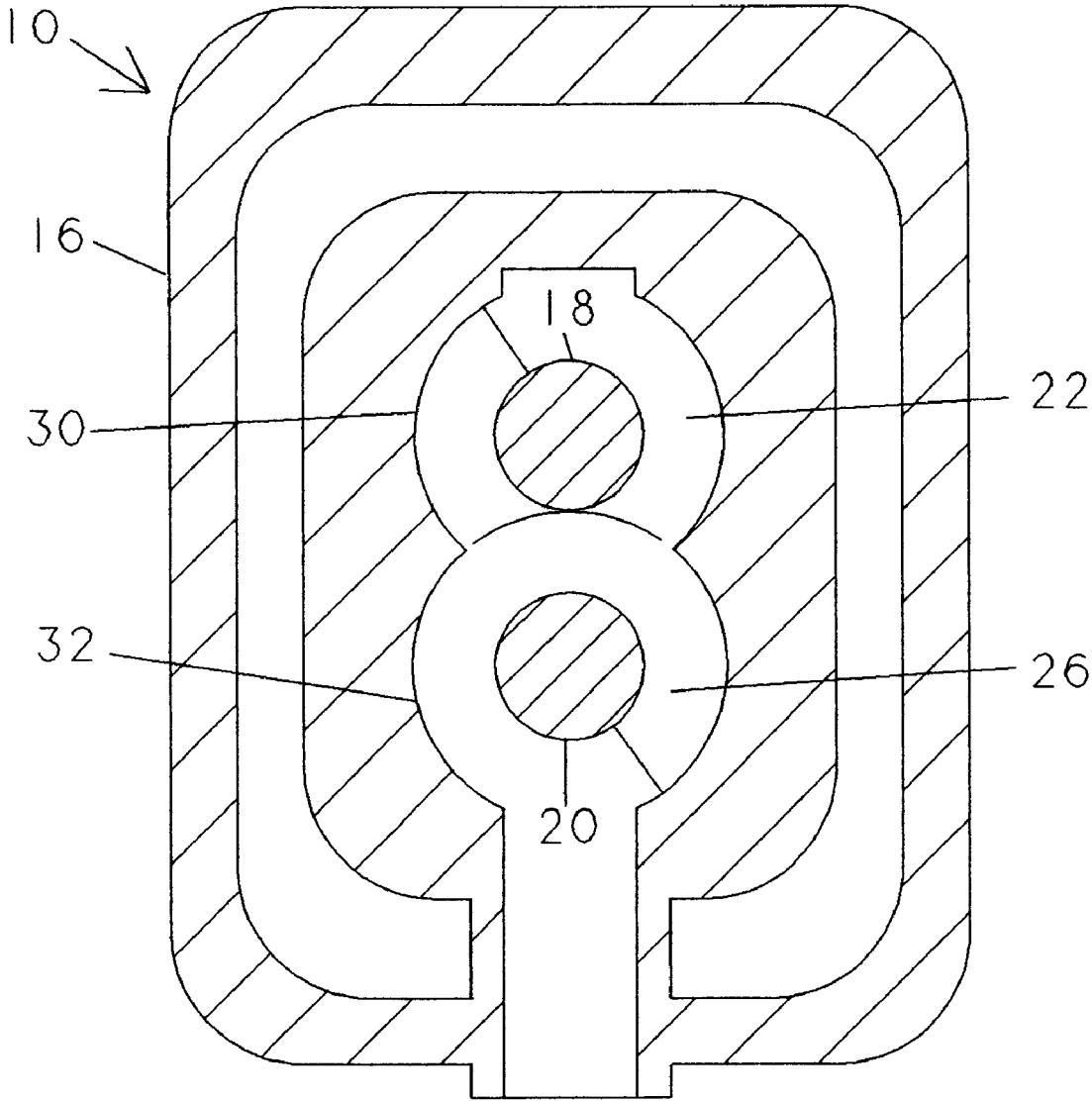
FIG. 3 is a transverse section taken along line 3—3 of FIG. 2.

The rotor assemblies 50 and 52 of the pump 48 of the present invention (see FIG. 2) rotate axially within rotor enclosure 54 of the pump housing, which may be a solid or split casing design with or without sleeves. While a horizontal axis of rotation for the rotor assemblies is shown, the present invention is equally effective for pumps having substantially any axis of rotation. FIG. 3 is a transverse section through the pump and shows the configuration of the rotor enclosure. A pump drive means (not shown) is connected to drive the shaft of the rotor assembly 50. A first drive gear 100 mounted on the rotor assembly 50 engages a second drive gear 102 on the second rotor assembly 52, such that when first rotor assembly 50 is driven by the drive means, rotor assembly 52 is also driven at the same rate, but in an opposite direction. Of course, instead of being geared, the rotor assemblies may be direct-connected, belted, chain-driven or drivingly connected by any other well known means. The drive means may be provided by any known prime mover and source of power practical for the circumstances, such as electric motors, gasoline or diesel engines, or steam and water turbines. Furthermore, any known mechanical seals may be used to provide a fluid-tight seal between the rotating shafts of the rotor assemblies and the stationary pump housing.

Wellhead fluids are drawn into pump through the inlets (from the wellhead through a pipeline, neither of which has been shown) and are displaced axially along the rotor assemblies toward the center of the pump where the wellhead fluids are discharged radially through the outlet. A pipeline (not shown) is attached to the outlet for transporting the fluids to a remote processing site.

The advantage of having separate stages is that the rotor assembly and enclosure design in each stage may be different. For example, the axial pitch of the threads, that is the axial distance from any point on one thread to the corresponding point on the next adjacent thread may be decreased from stage to stage. Further, the lead angle, that is the angle between the thread of the rotor helix and a plane perpendicular to the axis of rotation may also be decreased. Likewise, the helix angle, that is, the axial distance the rotor helix advances in one complete revolution around the pitch surface may also be decreased. Other parts of the rotor assembly/enclosure design—such as the enclosure dimensions, shaft diameter, and thread shape as a function of distance from the shaft—may be changed from stage to stage. This allows the inlet volumetric rate of each stage to be different, which allows the pump to be more efficient when pumping multiphase streams. In this embodiment, the rotor/enclosure design may change within a stage as long as this does not significantly change the volumetric rate. Because these streams are compressible, as the pressure rises, the volumetric rate (at that pressure) decreases. The subject multistage pump is designed so each successive stage, from the inlet to the outlet, has a smaller inlet volumetric rate than that of the previous stage. That is the last stage 90 has the smallest inlet volumetric rate, the middle stage 88 has an intermediate inlet volumetric rate, and the inlet stage 86 has the largest inlet volumetric rate.

In order for all the fluids that flow into the inlet of the pump to flow through the middle stage 88, the first stage 86 must compress the fluids from the inlet volumetric rate the first stage can handle to the smaller inlet volumetric rate that the middle stage can handle. Similarly, in order for all the fluids that flow into the middle stage 88 to flow through the last stage 90, the middle stage must compress the fluids from the inlet volumetric rate of the middle stage to the smaller inlet volumetric rate of the last stage 90. If the three stages were all of the same design, then the first and middle stages would do very little work on a compressible stream (only enough to compensate for temperature increases and slips) since very little work would be required to provide the same volume of fluids to the last stage as entered the first stage.

In essence, the last stage 90 takes its suction from the discharge of the middle stage 88 which takes its suction from the discharge of the first stage 86. By designing the pump to have stages acting in series within a single housing with progressively smaller stage inlet volumetric rates through which the flow progresses from inlet to outlet, a significant efficiency improvement can be achieved for highly compressible inlet streams.

For ease of discussion, only one half of the rotor is discussed. As depicted in FIG. 2, an even number of stages are mounted on each shaft of the two rotor assemblies, one half facing one direction and the other half facing the opposite direction. In this arrangement, the axial thrust of one half is balanced by the other. Nevertheless, since a pump is generally not of high precision manufacture and wear and minor irregularities may cause differences in eddy currents around the rotor stages, the pump must be designed to take some thrust in either direction. The rotor assemblies, as well as the other parts of the pump, may be manufactured of almost any known common metals or metal alloys, such as cast iron, bronze, stainless steel, as well as carbon, porcelain, glass, stoneware, hard rubber, and even synthetics.

In simplified terms, the efficiency improvement of the present invention may be defined as the power required by a twin-screw pump is proportional to the inlet-volumetric-rate times the pressure-boost. As such, it is simple to compare the efficiency of a traditional pump to that of a multistage pump. Let the pressure boost of each of the three stages of a multiple-stage pump be $DP_1$, $DP_2$, and $DP_3$—so that the total pressure boost of the three stage pumps is DP, where $DP=DP_1+DP_2+DP_3$.

Now compare the efficiency of the three stage pump to that of a traditional pump with the same total pressure boost of DP and the same volumetric rate. Roughly, the power required, $P_1$, of the traditional pump for an inlet volumetric rate of Q is equal to a constant, C, times DP times Q; put differently, $P_1=C\times DP\times Q$. Or, since DP is equal to the sum of the three stage DP's:

$$P_1=C\times(DP_1\times Q+DP_2\times Q+DP_3\times Q) \qquad \text{Equation 1}$$

Now the power required of the three stage pump, $P_3$, is just the sum of the powers required for each stage. For each stage, the power required is the same constant, C, times DP for that stage, times the stage inlet volumetric rate $Q_i$, where I can be 1, 2, or 3 for stages 1, 2, or 3, respectively. Thus the power for the three stage pump, $P_3$, is $P_3=C\times DP_1\times Q_1+C\times DP_2\times Q_2+C\times DP_3\times Q_3$. Or, by collecting terms:

$$P_3=C\times(DP_1\times Q_1+DP_2\times Q_2+DP_3\times Q_3) \qquad \text{Equation 2}$$

The power efficiency improvement of the three phase pump can be seen by comparing Equation 1, the power required of a traditional pump, to Equation 2, the power required of a three phase pump. The only difference is that in Equation 1 all the terms have Q, and in Equation 2 the terms have $Q_1$, $Q_2$, and $Q_3$. Now Q, the volumetric rate at the pump inlet, is equal to $Q_1$, since the pumps are sized to handle the same inlet volumetric rate. However, $Q_2$ is less than $Q_1$ by design and therefore less than Q. Therefore the term in Equation 2 for the power requirement of the second stage is less than the corresponding term in Equation 1 for the traditional pump by a factor of $Q_2/Q$. Furthermore, $Q_3$ is even smaller than $Q_2$, and consequently the term in Equation 2 for the power requirement of the last stage is less than the corresponding term in Equation 1 for the traditional pump by a factor of $Q_3/Q$.

So it is easy to see that the efficiency improvement of the multi-stage twin-screw pump over the traditional twin-screw pump is a consequence of the reduced stage inlet volumetric rate capacities of the rotors stages downstream of the first stage. The extent of the efficiency improvement depends on the stage inlet volumetric rate reduction as compared to the pump inlet volumetric rate, and the pressure boost of each stage. The stage inlet volumetric rate for each stage is determined by the speed of revolution (the same for all stages) and the design of the rotor/enclosure for that stage (as discussed above).

A significant advantage of this invention is that the stages can be designed such that for high gas-fraction multiphase streams the problems associated with seals loss and overheating/seizing are reduced as compared to a traditional twin-screw pump. The first stage can provide a modest pressure boost and associated liquid fraction increase. The next stage can further increase the pumped stream pressure and liquid fraction. And so on, until the last stage, which is provided a reasonable liquid fraction to allow significant further pressure boosting. The system is thus designed to reduce the likelihood of pump seizing, of loss of pump seal, and to reduce power requirements for highly compressible inlet streams. The fact that less power is used means that less heat needs to be dissipated. This, together with the fact that the work may be more evenly distributed along the rotor than for traditional pumps, significantly reduces the likelihood of overheating, loss of seal, and seizing for a multistage pump.

Each of the chambers between stages provides access to the pumped stream. This allows for (1) cooling of the stream before the stream enters the next stage, and/or (2) cooling, sealing, and efficiency enhancements for the previous stage as provided for in my earlier U.S. Pat. No. 5,779,451. The gathering of the pumped stream liquids in chambers between stages may be enhanced by increasing the body enclosure dimensions at these chambers.

Figure 4:
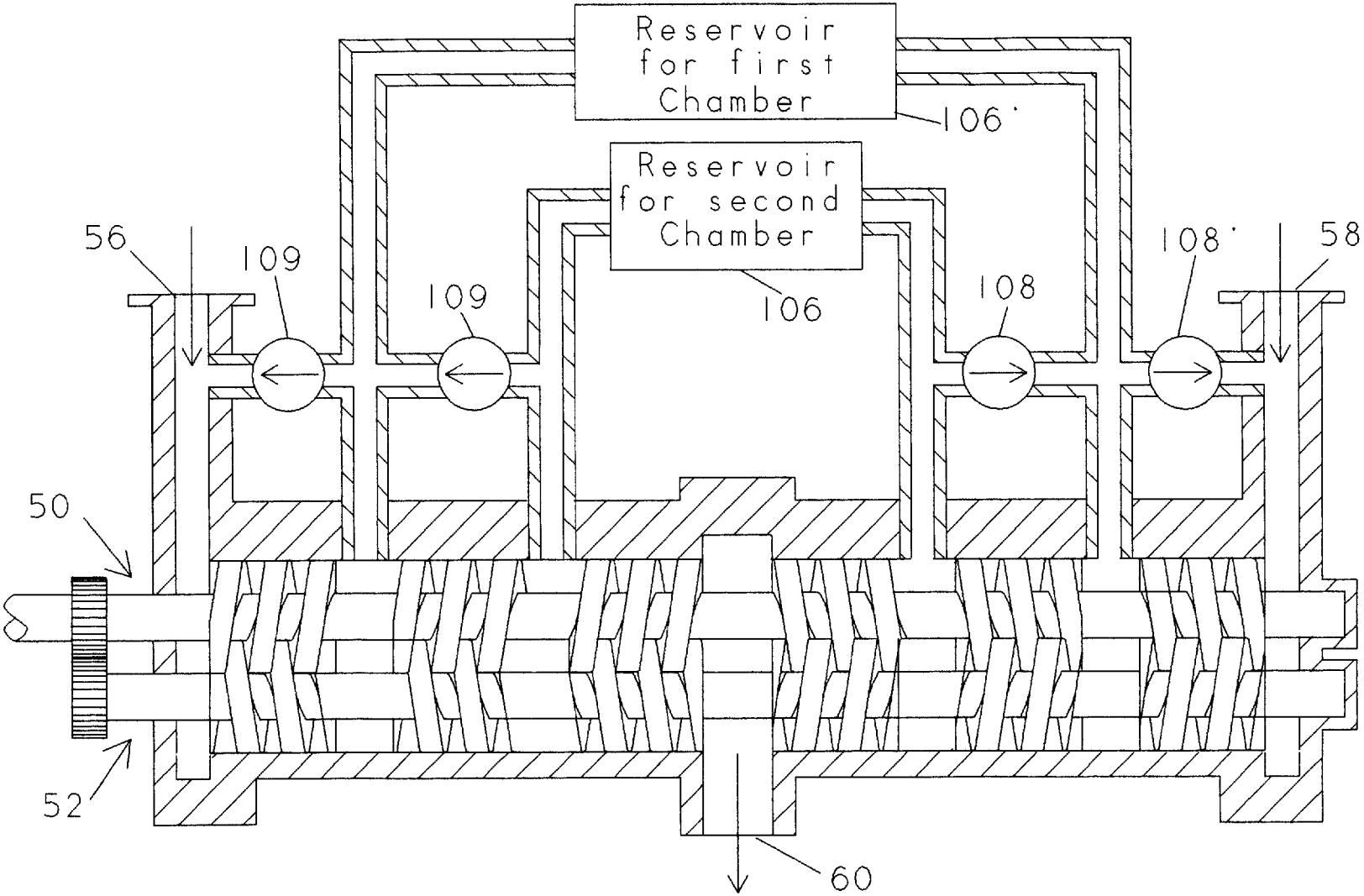
FIG. 4 is a longitudinal section through an alternate embodiment of the multistage pump of the present invention.

Thus far the discussion of the invention has focused on the pumping of highly compressible streams. Further discussion is required to explain the performance on liquid or incompressible streams. As was pointed out in the background discussion, traditional twin-screw pumps have a constant volumetric rate capacity along the rotors to avoid severe mechanical stresses when pumping incompressible fluids. The key to understanding how the invention described here with stages with different volumetric rate capacities avoids these mechanical problems is to realize that in this embodiment, while the volumetric rate capacity varies between stages, the volumetric rate capacity is constant within a stage. Consequently, there is not a problem within a stage. But clearly by design each stage after the first can only handle part of the incompressible fluids flow from the previous stage. To accommodate incompressible fluids flow, each of the non-pumping chambers 92, 94, 96, 98 between the pumping stages 86, 88, 90, 86', 88', 90' is connected to the inlet of the previous stage of the pump and may be connected to a pressure reservoir 106, 106' (see FIG. 4). A mechanism associated with each chamber, such as an associated valve 108, 108', 109, 109' prevents unintended flow from between the stage inlets and the non-pumping chambers. The connections between the chambers and the inlet may or may not have pumps (not shown) in them.

Figure 5:
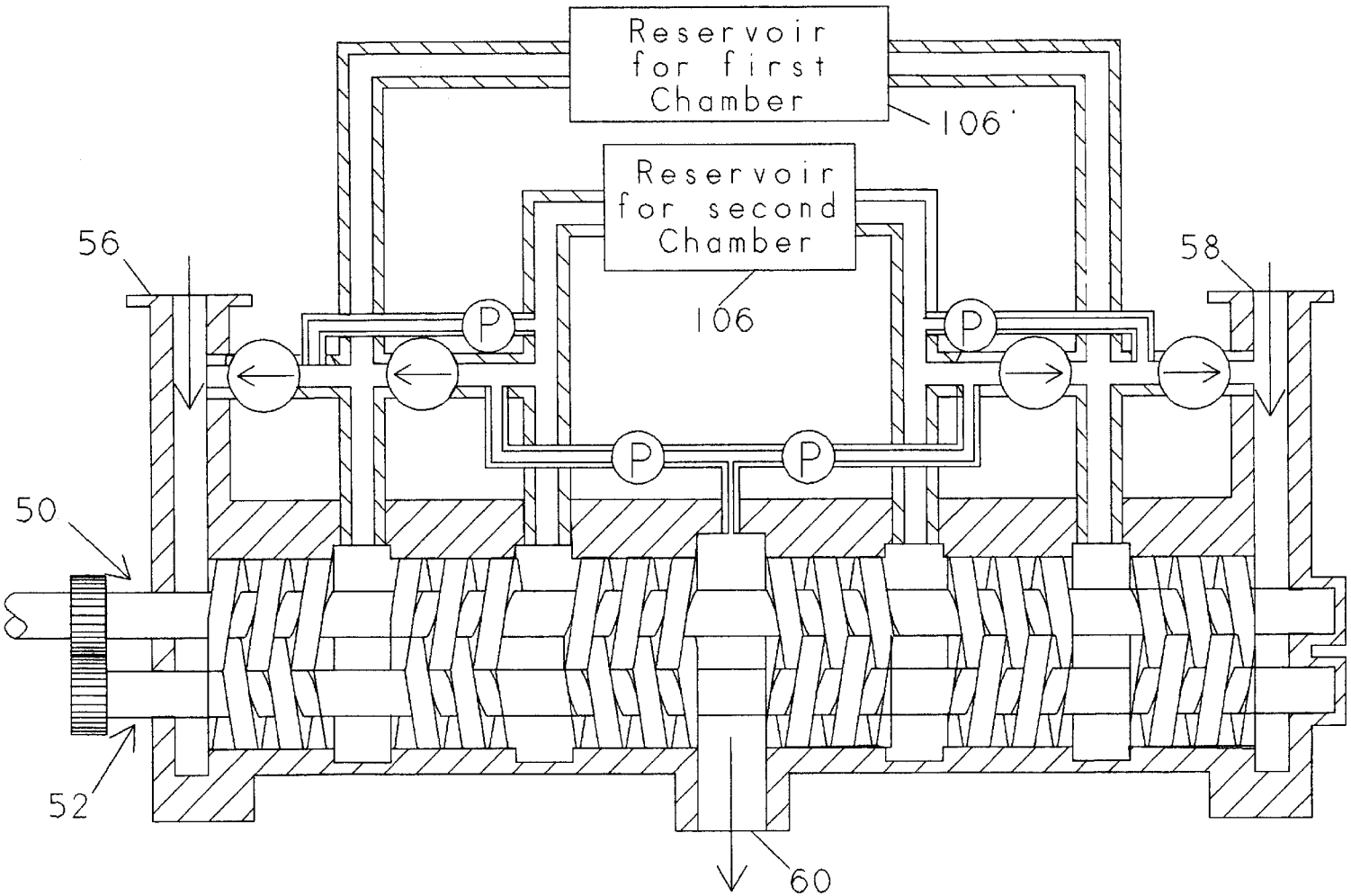
FIG. 5 is a longitudinal section through another embodiment of the multistage pump of the present invention.

If the connections do not have pumps or pressure reservoirs, then the first stage of the pump must pump incompressible liquids to a pressure above the associated valve opening pressure. Fluids flow through the other downstream stages, but since the inlet volumetric rate of the second stage is less than that of the first stage, the pressure rises in the chamber between the first and second stages. Once this pressure rises above that valve opening pressure, this causes the associated valve to open and flow not ingested by the second stage flows through the connection between the chamber and the inlet of the first stage. In this situation, the multiphase pump has a lower volumetric-efficiency than a traditional single-stage pump. This poor efficiency may be improved by including pumps in the connection lines, as shown in FIG. 5.

In the case of a multiphase flow stream, the compressibility of the stream can vary with time. If the multiphase flow stream is homogeneous and sufficiently compressible, then the pump will work without any flow through the connecting lines. Alternatively, a multiphase flow stream entering, a pump may alternate in time between high gas-fraction sections (very compressible) and low gas-fraction sections (slightly compressible). The sequence of events that happen in the pump ingesting a multiphase stream with a time-varying compressibility can be understood by assuming that at some initial time the non-pumping chamber between the first and second stage is gas filled. If a low gas-fraction section of flow stream enters the pump, this low gas-fraction section is pumped into the chamber. While the low gas-fraction section is being pumped into the chamber, the pressure in the chamber rises. If this pressure rises above the valve trip level, then fluid flows through the valve to the first stage inlet. On the other hand, if the chamber pressure remains below the valve trip level until a high gas-fraction fluid section (following the low gas-fraction section) is pumped into the chamber, then as the high gas-fraction fluid is pumped into the chamber, the pressure in the chamber will decrease and the pump will continue to pump without fluid flowing through the connecting line. The flow-stream average gas-faction, the ratio of the volume of the low gas-fraction section compared to the volume of the non-pumping chamber, and the valve pressure setting determines whether or not fluid flows through the connecting line. Optional pressure reservoirs may be attached to the chambers to reduce the ratio and allow the pump to run without flow in the connecting lines for inlet streams with longer low gas-fraction sections. Alternatively, the flow through the connecting lies can be used to drive an auxiliary pump that pressure boosts part of the flow stream.

In the case that the connections do not have pressure reservoirs, but do have pumps, one way to drive these pumps is with fluids flowing from a chamber to an upstream stage inlet. Alternatively, these pumps may be driven by an external power source. With such a pump, part or all off the excess fluids in the non-pumping chamber between the first and middle stages may be pumped to a downstream chamber or the multistage pump outlet. A variety of pumps may be used for the flow in these connections, including pumps with no moving parts, such as jet pumps.

The optional pressure reservoirs associated with each interstage or non-pumping chamber allow pumping of incompressible slugs without flow between the chamber and upstream stage inlets through the fluid lines. They also allow the pump to run at the same speed while processing incompressible slugs as while processing compressible fluids without a large increase in required power—that is, without using the power of a single stage pump. This is possible for the following reasons. The optional pressure reservoirs are vessels designed to be normally filled with a large volume of compressible fluids—usually gas. The gas is accumulated in these vessels while compressible streams are being pumped through each interstage chamber. When an incompressible slug is pumped by a chamber's upstream stage, not all of the fluids delivered by the upstream stage are pumped away immediately by the smaller inlet volumetric capacity downstream stage. The extra fluids are delivered to the pressure reservoir which then increases slightly in pressure. As long as the volume of extra fluids from the incompressible fluids slug is small as compared to the reservoir volume, then the pressure rise in the reservoir will be small and the power requirement and the efficiency of the pump will only change slightly.

In order to minimize the number of changes between flow and no flow through the connections between the non-pumping chambers and the pump inlet, larger pressure reservoirs may be used and/or a buffer tank may be installed just upstream of the pump to filter the gas-factions variations of the inlet stream.

For a constant pump speed, as the gas fraction of the inlet stream varies, a traditional single-stage twin-screw pump ingests a fairly constant volumetric rate and requires a fairly constant power. For a suitable multiphase flow stream, a multi-stage pump uses less power for the same volumetric rate. If a multi-stage pump, running at a constant speed, without optional reservoirs and auxiliary pump ingests an incompressible stream, the power requirements are the same as for a compressible stream and the throughput volumetric rate reduces to that of the final stage of the pump; if optional reservoirs are used and flow through connecting line back to the pump inlet is avoided, then the power requirements rise slightly and the throughput volumetric rate remains that of the first stage of the pump.

The present invention may be subject to many modifications and changes without departing from the spirit of essential characteristics thereof. The above described embodiments should therefore be considered in all respects as illustrative and not restrictive of the scope of the present invention as defined by the appended claims.

I claim:

1. A pump, comprising:

a housing, said housing having an internal rotor enclosure, said enclosure having an inlet and an outlet;

a plurality of rotors operatably contained in said enclosure, each rotor having a shaft and a plurality of outwardly extending threads affixed thereon, said rotors being shaped to provide a non-uniform volumetric delivery rate along the length of each rotor, said rotors further having a plurality of threaded pumping stages separated by unthreaded non-pumping chambers;

a pressure reservoir for each non-pumping chamber; and means for rotating said rotors, whereby a fluid stream entering from said inlet is subjected to a pumping action to transport said fluid stream to exit said enclosure through said outlet.

2. The pump of claim 1 wherein each non-pumping chamber between two pumping stages is connected to an inlet of an upstream pumping stage by a fluid line with a control valve to prevent flow unless the chamber pressure exceeds the valve set pressure.

3. The pump of claim 2, further comprising a pump in each said fluid line, each said fluid line pump discharging fluid from said line to the outlet of a downstream pumping stage.

4. The pump of claim 3, wherein each said pump in a connecting line is powered by the fluid flow in the fluid line back to an upstream inlet.

5. A multi-stage pump, comprising:

a housing defining an internal rotor enclosure having a first plurality of threaded pumping chambers separated by a second plurality of unthreaded non-pumping chambers extending sequentially between an inlet and an outlet, and a pressure reservoir for each said non-pumping chamber;

at least two rotors operatably mounted in said housing and extending substantially the entire length thereof, each of said at least two rotors having a shaft with a first plurality of pumping stages each defined by a set of outwardly directed threads affixed on said shaft and separated by unthreaded non-pumping portions, each said pumping stage being aligned with a respective pumping chamber of said housing; and means for rotating said rotors, whereby a fluid stream entering from said inlet is subjected to a pumping action to transport said fluid stream to exit said enclosure through said outlet.

6. The multi-stage pump according to claim 5 wherein:

each non-pumping chamber between two pumping stages is connected to an inlet of an upstream pumping stage by a fluid line with a control valve to prevent flow unless the pumping camber pressure exceeds the valve set point.

7. The multi-stage pump according to claim 6, further comprising:

a plurality of pumps driven by the flow in a fluid line between said non-pumping chamber and said upstream-stage inlet for pumping fluids towards said pump outlet.

8. The multi-stage pump according to claim 5 wherein each successive said non-pumping chamber has an increased rotor enclosure diameter.

9. A multi-stage pump, comprising:

housing means defining a plurality of pumping stages each having an internal rotor enclosure, each said enclosure having a non-pumping inlet and outlet, and a pressure reservoir connected to each said non-pumping inlet;

a plurality of rotors operatably contained in said stages, said rotors and rotor enclosures being shaped to provide a smaller inlet volumetric delivery rate at the last stage than at the first stage;

a plurality of fluid lines connecting non-pumping chambers to upstream stage inlets to enable the pump to handle liquid; and means for rotating said rotors, whereby a fluid stream entering from said pump inlet is subjected to a pumping action to transport said fluid stream to exit through said pump outlet.

10. The pump of claim 9 further comprising at least one valve means in said fluid lines connecting non-pumping chambers to control flow through said fluid lines.

11. The pump of claim 9 further comprising a pump in at least one of said fluid lines, said pump discharging fluid from said line to the outlet of a downstream pumping stage.

12. A pump, comprising:

a housing having a plurality of stages, each said stage having an internal rotor enclosure, each said enclosure having a non-pumping inlet and outlet, pressure reservoirs connected to each said non-pumping inlet;

a plurality of rotors operatably contained in said stages, each rotor having a shaft with a plurality of spaced sections each having thereon outwardly extending threads, said rotors and rotor enclosures being shaped to provide a smaller inlet volumetric delivery rate at the last stage than at the first stage a plurality of fluid lines connecting non-pumping chambers to upstream stage inlets to enable the pump to handle liquid;

valve means in said fluid lines connecting non-pumping chambers to control flow through said fluid lines; and means for rotating said rotors, whereby a fluid stream entering from said pump inlet is subjected to a pumping action to transport said fluid stream to exit through said pump outlet.

13. The pump of claim 12 wherein each non-pumping chamber has an increased rotor enclosure diameter.

14. The pump of claim 12 further comprising pump means connected to said fluid lines; said fluid line pumps discharging fluids from said lines to the inlet of a downstream pumping stage.

15. The pump of claim 14 where said fluid line pumps are driven by fluid flow in the fluid line back to an upstream inlet.

16. A pump system comprising:

a plurality of chambers each having an internal rotor enclosure, said enclosure having a non-pumping inlet and outlet;

at least one pressure reservoir connected to each said non-pumping inlet;

a plurality of rotors operably contained in said chambers, each rotor having a shaft and a plurality of outwardly extending threads affixed thereon, said rotors and rotor enclosures being shaped to provide a smaller inlet volumetric delivery rate at the last chamber than at the first chamber;

a plurality of fluid lines connecting non-pumping chambers to upstream chamber inlet to enable the pump to handle liquid;

at least one flow control valve in each said fluid lines connecting non-pumping chambers to control flow upstream through said fluid lines and to stop downstream flow through said fluid lines; and means for rotating said rotors, whereby a fluid stream entering from said pump inlet is subjected to a pumping action to transport said fluid stream to exit said chambers through said pump outlet.

17. The pump of claim 16 wherein each succesive non-pumping chamber has an increased rotor enclosure diameter over the preceding upstream non-pumping chamber.

18. The pump of claim 16 further comprising:

at least one secondary pump driven by upstream flow in said fluid lines, said secondary pump pumping fluids to an outlet of a downstream chamber.

19. A multistage pump comprising:

housing means defining a plurality of sequentially smaller inlet volume pumping stages between a pump inlet and a pump outlet, each pumping stage having an internal rotor enclosure separated from the adjacent stages by non-pumping chambers, each said non-pumping chamber having a chamber inlet and a chamber outlet;

pressure reservoirs connected to non-pumping chambers;

a plurality of rotor assemblies operably mounted in said housing, each rotor assembly having a shaft extending through at least one stage of said housing and a plurality of pumping portions fixed to a shaft and lying within a respective pumping chamber, each said pumping portion having outwardly directed integral threads which engage with like threads of adjacent rotor assemblies to provide successively smaller inlet volumetric delivery rates between successive stages from said housing inlet to said housing outlet;

a plurality of fluid lines connecting said non-pumping chambers to an inlet of an upstream pumping stage to enable the pump to handle high liquid fraction inlet streams;

valve means in each said fluid lines to control flow upstream through said fluid lines and to prevent downstream flow through said fluid lines; and means for rotating said rotors, whereby a fluid stream entering from said pump inlet is subjected to a pumping action to transport said fluid stream to exit said stages through said pump outlet.

* * * * *